US009215524B2

(12) United States Patent
McKinnon et al.

(10) Patent No.: US 9,215,524 B2
(45) **Date of Patent: *Dec. 15, 2015**

(54) ACOUSTIC HORN MANIFOLD

(71) Applicants: Geoffrey P. McKinnon, Woonsocket, RI (US); Steven Desrosiers, Woonsocket, RI (US)

(72) Inventors: Geoffrey P. McKinnon, Woonsocket, RI (US); Steven Desrosiers, Woonsocket, RI (US)

(73) Assignee: LOUD Technologies Inc, Woodinville, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/489,340

(22) Filed: Sep. 17, 2014

(65) Prior Publication Data

US 2015/0000998 A1 Jan. 1, 2015

Related U.S. Application Data

(63) Continuation-in-part of application No. 13/832,817, filed on Mar. 15, 2013.

(51) Int. Cl.
*H04R 25/00* (2006.01)
*H04R 1/40* (2006.01)
(Continued)

(52) U.S. Cl.
CPC ..... *H04R 1/403* (2013.01); *G10K 11/22* (2013.01); *G10K 11/26* (2013.01); *H04R 1/30* (2013.01); *H04R 1/345* (2013.01); *H04R 2201/34* (2013.01)

(58) Field of Classification Search
CPC ..... H04R 1/345; H04R 1/26; H04R 1/30; H04R 27/00; H04R 1/021; H04R 1/227; H04R 1/2803; H04R 1/2834; H04R 1/288; H04R 1/403; H04R 2209/022; H04R 3/00; H04R 9/025; H04R 2201/34; G10K 11/025; G10K 11/26; G10K 11/22; H04T 1/30
USPC ..... 381/337–343; 181/151, 187, 188, 177, 181/179
See application file for complete search history.

(56) References Cited

U.S. PATENT DOCUMENTS 1,752,526 A 4/1930 Hinckley
2,058,132 A 10/1936 Cirelli
(Continued)

FOREIGN PATENT DOCUMENTS

GB 2 230 682 A 10/1990
JP 63-236498 A 10/1988
JP 2009-65609 A 3/2009

OTHER PUBLICATIONS

"Airline LA12: 3-Way Symmetrical High Output Line Array System," Product Data, Apr. 2012, Coda Audio GmbH, Hannover, Germany, <http://www.codaaudio.com/products/line-arrays/airline-la-series/airline-la12/airline-la12 -overview/>, p. 5.
(Continued)

*Primary Examiner* — Davetta W Goins
*Assistant Examiner* — Phylesha Dabney
(74) *Attorney, Agent, or Firm* — Christensen O'Connor Johnson Kindness PLLC

(57) ABSTRACT

The acoustic horn manifold (22) is composed of a vertical array of horn pairs (26A-26G) arranged in stacked relationship to each other. The horns (27L and 27R) of each pair have entrance openings (40L and 40R) on first common plane 44 and at the same elevation and disposed side-by-side to each other. The mouths (50L and 50R) of the horn pairs are in directional alignment with each other and stacked vertically on top of each other. The mouths may be laterally offset somewhat from each other and/or may extend forwardly from respective horn entrances at different distances from each other.

18 Claims, 12 Drawing Sheets

(51) Int. Cl.

| | |
|---|---|
| ***G10K 11/26*** | (2006.01) |
| ***H04R 1/30*** | (2006.01) |
| ***G10K 11/22*** | (2006.01) |
| *H04R 1/34* | (2006.01) |

(56) References Cited

U.S. PATENT DOCUMENTS

| | | | |
|---|---|---|---|
| 4,344,504 | A | 8/1982 | Howze |
| 4,629,029 | A | 12/1986 | Gunness |
| 4,923,031 | A | 5/1990 | Carlson |
| 5,070,530 | A | 12/1991 | Grodinsky |
| 5,519,572 | A | 5/1996 | Luo |
| 5,715,322 | A | 2/1998 | Yoshioka |
| 6,035,051 | A | 3/2000 | Sato |
| 6,112,847 | A | 9/2000 | Lehman |
| 6,393,131 | B1 | 5/2002 | Rexroat |
| 6,394,223 | B1 | 5/2002 | Lehman |
| 6,668,969 | B2 | 12/2003 | Meyer |
| 6,712,177 | B2 | 3/2004 | Ureda |
| D500,025 | S | 12/2004 | Vincenot |
| D500,306 | S | 12/2004 | Noselli |
| 7,392,880 | B2 | 7/2008 | Buck |
| 7,454,029 | B2 | 11/2008 | Andrews |
| 7,590,257 | B1 | 9/2009 | Blanchard |
| 8,199,953 | B2 | 6/2012 | Buccafusca |
| 8,224,001 | B1 | 7/2012 | Waller |
| 2002/0038740 | A1 | 4/2002 | Ureda |
| 2003/0132056 | A1 | 7/2003 | Meyer |
| 2004/0218773 | A1 | 11/2004 | Andrews |
| 2006/0169530 | A1 | 8/2006 | Noselli |
| 2012/0213387 | A1 | 8/2012 | Blore |

OTHER PUBLICATIONS

"Cohedra™ CDR 208 S/T" (Product Information), HK Audio, Germany, <www.hkaudio.com/products.php?id=205>, 2011, 5 pages.

"DSA250i: 2-Way Full-Range Digitally Steerable Array," Part No. RD0383 (A) DSA250i SPEC (Specifications), Eastern Acoustic Works, Whitinsville, Mass., <www.eaw.com/docs/2_legacy.../DSA250i/DSA250i_SPECS_revA.pdf>, Feb. 2007, 5 pages.

"Flashline : TFS-900H: Four-Way Line Array Module" (Product Information), Oct. 2011, Turbosound, Partridge Green, UK, <http://www.turbosound.com/docs/products/TFS-900H.shtml>, 2 pages.

"GTO Tech Specs" (Product Information), Outline s.r.l., Flero, Italy, <http://89.96.202.198/GTO/index_eng_3.htm>, 12 pages.

International Search Report and Written Opinion mailed Jun. 6, 2014, issued in corresponding International Application No. PCT/US2014/021959, filed Mar. 7, 2014, 9 pages.

"KF740: 3-Way Full Range Loudspeaker," Part No. RD0510 (A) KF740 SPEC (Specifications), Eastern Acoustic Works, Whitinsville, Mass., <http://www.eaw.com/KF740>, Nov. 2009, 7 pages.

"KF760," Part No. KF760/0002962/2 (Specifications), Eastern Acoustic Works, Whitinsville, Mass., <http://www.eaw.com/KF760>, Apr. 2002, 3 pages.

"KF910," Part No. KF910/888056(A)/2 (Specifications), Eastern Acoustic Works, Whitinsville, Mass., <http://www.manualslib.com/download/41874/Eaw-Kf910.html>, Jan. 29, 1999, 3 pages.

"KIVA Modular WST® Line Source," Product Spec Sheet KIVA_SP_EN_04-1/06-10, L-Acoustics, Marcoussis, France, <http://www.l-acoustics.com/products-kiva-31.html>, Jun. 2010, 1 page.

"LS432," Publication No. LS432-888138(A)/2 (Technical Specifications ), Eastern Acoustic Works, Whitinsville, Mass., <eshop.prodance.cz/Files/LS432_POLAR.pdf>, Feb. 1, 1999, 21 pages.

"LS832," Publication No. LS832-888139 (A)/2 (Technical Specifications), Eastern Acoustic Works, Whitinsville, Mass., <eshop.prodance.cz/Files/LS832_POLAR.pdf>, 21 pages.

"MILO™: High-Power Curvilinear Array Loudspeaker," Product No. 04.132.096.01 C, Datasheet, Meyer Sound Laboratories Inc., Berkeley, Calif., <http://www.meyersound.com/products/mseries/milo/>, 2003, 4 pages.

"MLA Compact™: Multi-Cellular Loudspeaker Array" (Product Information), Martin Audio, London, <http://www.martinaudio-mla.com/downloads/brochuredownloads>, 10 pages.

"MLA™ Multi-Cellular Loudspeaker Array: MLA System Dual Hybrid® Bass Section" (Product Information), Martin Audio, London, <http://www.martinaudio-mla.com/downloads/brochuredownloads>, 2010, p. 15.

"NTL720: 3-Way Self-Powered, 110°×12°," Part No. NTL720 SPEC (Specifications), Eastern Acoustic Works, Whitinsville, Mass., <http://www.eaw.com/NTL720>, Nov. 2007, 3 pages.

"PACRIM Line Array PA Speaker System From Turnaround360" (Product Information), PacRim, UK, <http://pacrim.co.uk/L5-longthrow.html>, 6 pages.

"VerTec © Series, Subcompact Models," Publication No. CAT VTSUB-25 (Product Information), JBL by Harman, Northridge, Calif., <http://www.jblpro.com/catalog/support/getfile.aspx?doctype=3&docid=1453>, Mar. 2011, 6 pages.

"VTX V25: RBI Radiation Boundary Integrator® and VTX Waveguide," Publication No. CAT VTX-25 (Product Information), JBL by Harman, Northridge, Calif., <http://www.jblpro.com/products/tour/vtx/specs.html>, Sep. 2012, 12 pages.

ACOUSTIC HORN MANIFOLD

FIELD OF INVENTION

The present invention relates to loudspeakers, and particularly to a line array of horn-type loudspeakers, and more particularly to an acoustic manifold for horn-type loudspeakers.

BACKGROUND

In the field of generating and distributing acoustical energy (e.g., audio), and in particular in situations where the acoustical energy is to be received and understood by a large number of listeners who are distributed over a given area, it is common to use a loudspeaker arrangement consisting of multiple horns, especially for high frequency sounds. Horns can be used not only to enhance the output from high frequency drivers, but also to control the directionality of the sounds being broadcast. Horns can be designed to provide specific directional acoustical energy distribution characteristics. In this regard, various shapes and configurations of horns have been utilized for acoustical energy distribution.

In modern loudspeaker systems, high frequency drivers are typically paired with lower frequency cone-type speakers, which are able to move much larger volumes of air than a high frequency driver coupled to a horn. Thus, generally, it is common to place a relatively large number of high frequency speaker drivers and corresponding horns in the same enclosure which may include relatively fewer lower frequency cone-type speakers. It is desirable to place the high frequency drivers in close enough proximity to each other to achieve a physical spacing between devices that is related to bandwidth. In this regard, the horn exits are spaced apart along a common plane at a distance which is less than a wavelength of the output sound across the primary operating bandwidth of the high frequency speaker, thereby in an effort to reduce or avoid grating lobes. Thus, there is a need for horn speaker arrangements that are very compact but still provide the desired directional control of the audio generated by the high frequency driver. The present disclosure provides high frequency horn-type speaker arrangements that seek to address the foregoing situation.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A speaker system comprising at least one horn pair, with each of the horns of the pair comprising a first horn having a first horn entrance, a first horn mouth spaced a first distance from the first horn entrance, and a formed, curved horn throat extending between the first horn entrance and the first horn mouth. Each horn pair also includes a second horn having a second horn entrance positioned side to side to the first horn entrance, a second horn mouth spaced a second distance from the second horn entrance, said second horn mouth disposed adjacent to the first horn mouth, and a formed throat extending between the second horn entrance and the second horn mouth. The first horn entrance and the second horn entrance are in a first common plane. Further, the first horn mouth and second horn mouth are disposed adjacent to each other in a first direction that is transverse to the first common plane on which the first and second horn entrances are located, and the first horn mouth and the second horn mouth are offset from each other in a second direction transverse to the first direction.

In a further aspect of the present disclosure, there is a change in distance from the first horn entrance to the first horn mouth in a direction that is transverse to the side-to-side direction between the first and second horn entrances, which is the same as the distance change from the second horn entrance to the second horn mouth, but the transverse distance change between the first horn entrance and the first horn mouth is in the opposite direction to the change in distance between the second horn entrance and the second horn mouth.

In a further aspect of the present disclosure, the first horn entrance is substantially at the same elevation as the elevation of the second horn entrance.

In a further aspect of the present disclosure, a first elevation change exists from the elevation of the first horn entrance to the first horn mouth, and a second elevation change occurs between the second horn entrance and the second horn mouth of substantially the same elevational difference between the first horn entrance and the first horn mouth, but in the opposite direction as the change in elevation between the first horn entrance and the first horn mouth.

In a further aspect of the present disclosure, the first and second horn mouths are positioned vertically one above the other.

In a further aspect of the present disclosure, the first and second horn mouths are aligned in a common second plane that is transverse to the first common plane.

In a further aspect of the present disclosure, the first and second horn mouths can be of generally the same shape. In one example, the shape of the first and second horn mouths may be rectilinear.

In a further aspect of the present disclosure, the speaker system comprises a plurality of horn pairs, with such horn pairs being disposed in stacked relationship to each other.

In a further aspect of the present disclosure, the first and second horn mouths terminate at a common third plane that is transverse to the first common plane.

In a further aspect of the present disclosure, the first distance separating the first horn entrance from the first horn mouth is different from the second distance separating the second horn entrance from the second horn mouth.

In a further aspect of the present disclosure, an acoustic horn manifold consists of a plurality of horn pairs, wherein each horn pair is disposed in stacked relationship to each other; and each horn pair comprises a first horn having a first entrance, a first mouth, and a curved throat extending between the first horn entrance and first horn mouth to position the first horn entrance a first distance from the first horn mouth. Each horn pair also comprises a second horn having a second horn entrance at a location side-to-side to the first entrance of the first horn, a second horn mouth aligned with the first horn mouth in a direction transverse to the side-to-side direction of alignment of the entrances of the first and second horns, and a curved horn throat extending between the second horn entrance and second horn mouth to position the second horn entrance a second distance from the second horn mouth. The first and second horn entrances are disposed on a common first plane, and the first distance separating the first horn entrance from the first horn mouth is different from the second distance separating the second horn entrance from the second horn mouth.

In a further aspect of the present disclosure, the first and second horn mouths are in stacked relationship to each other.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
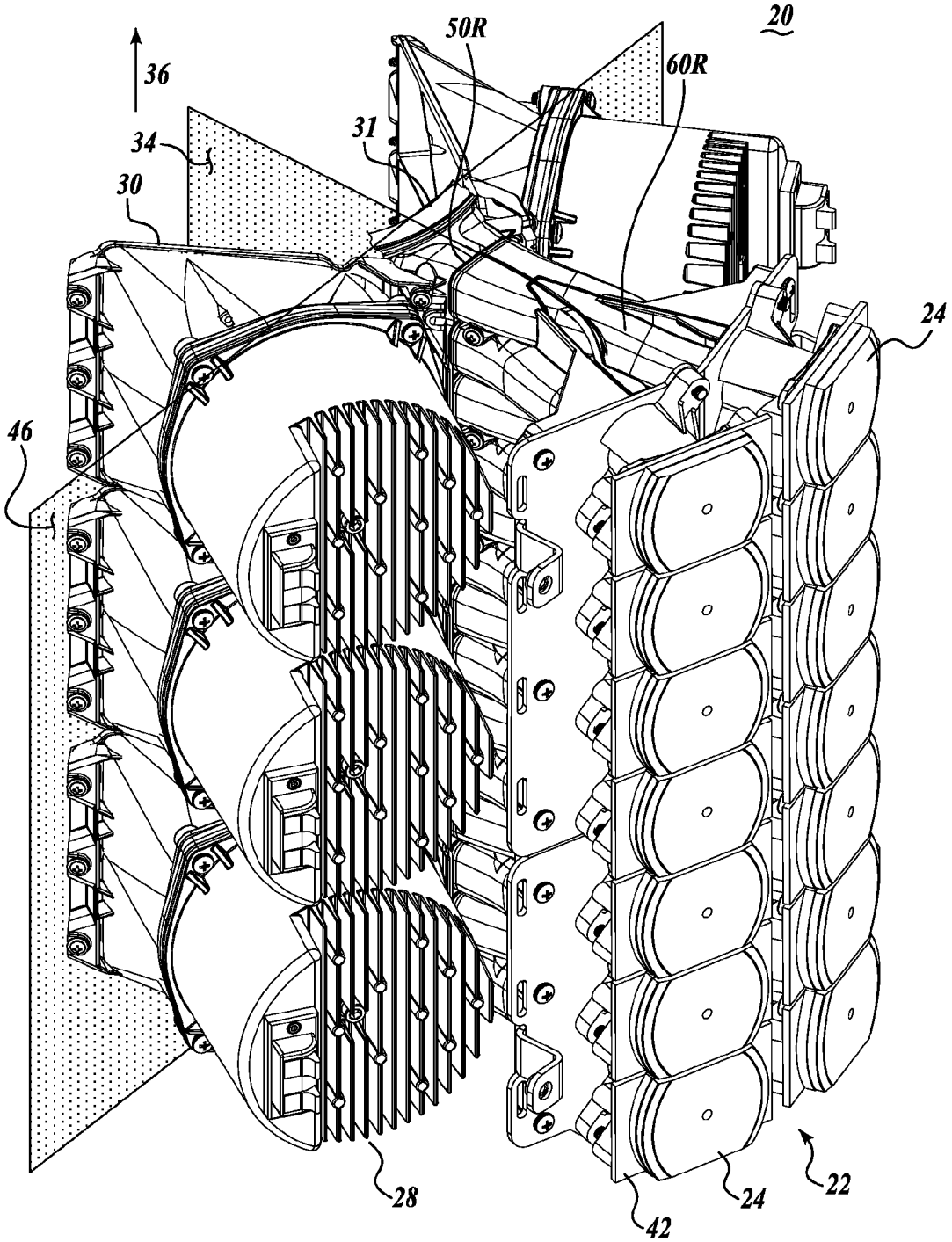
FIG. 1A is a rear perspective view of a partial speaker assembly illustrating a high frequency horn array with corresponding drivers, as well as lower frequency cone speakers located on each side of the high frequency horns.
Figure 1B:
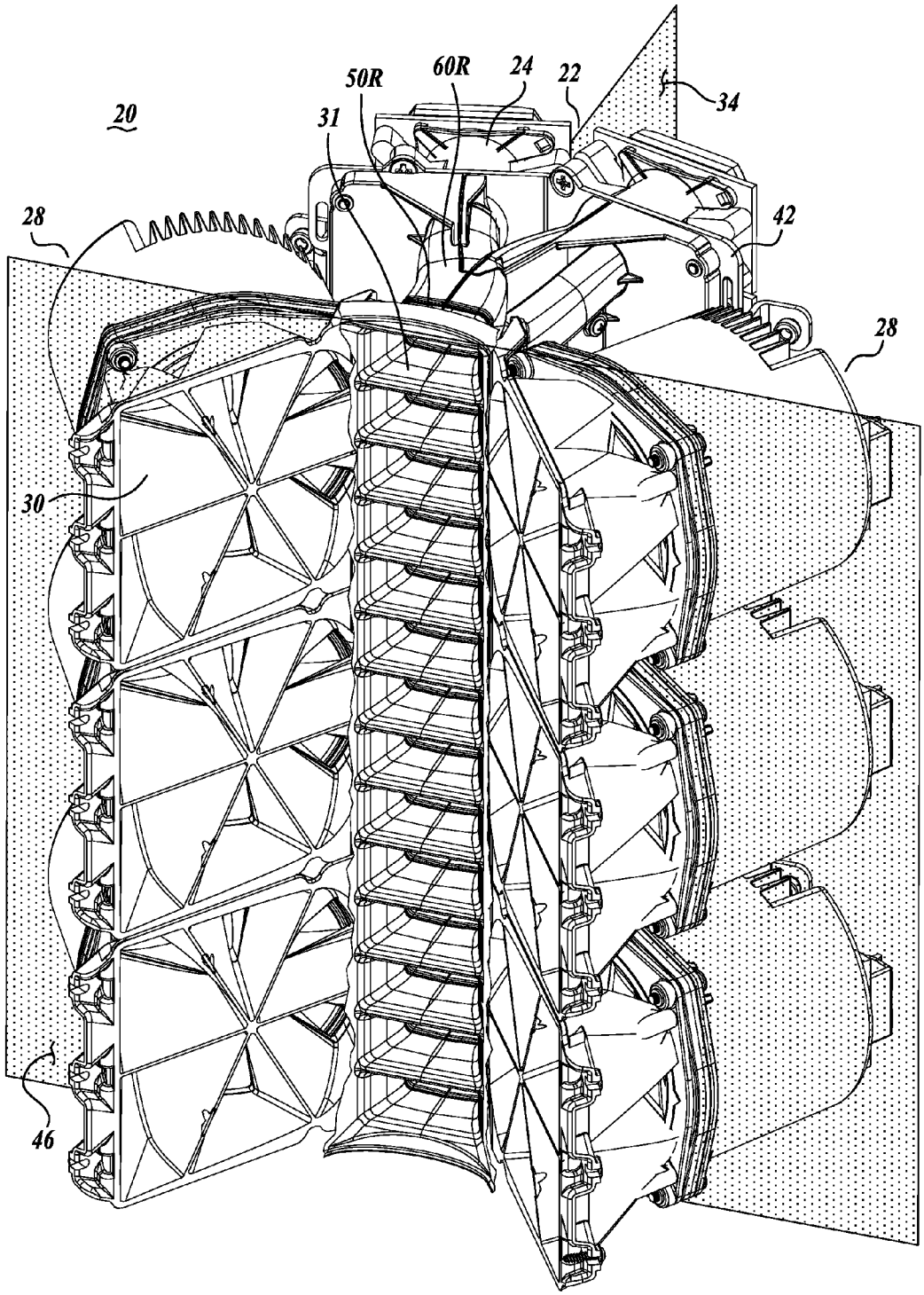
FIG. 1B is a front perspective view of FIG. 1A.
Figure 2:
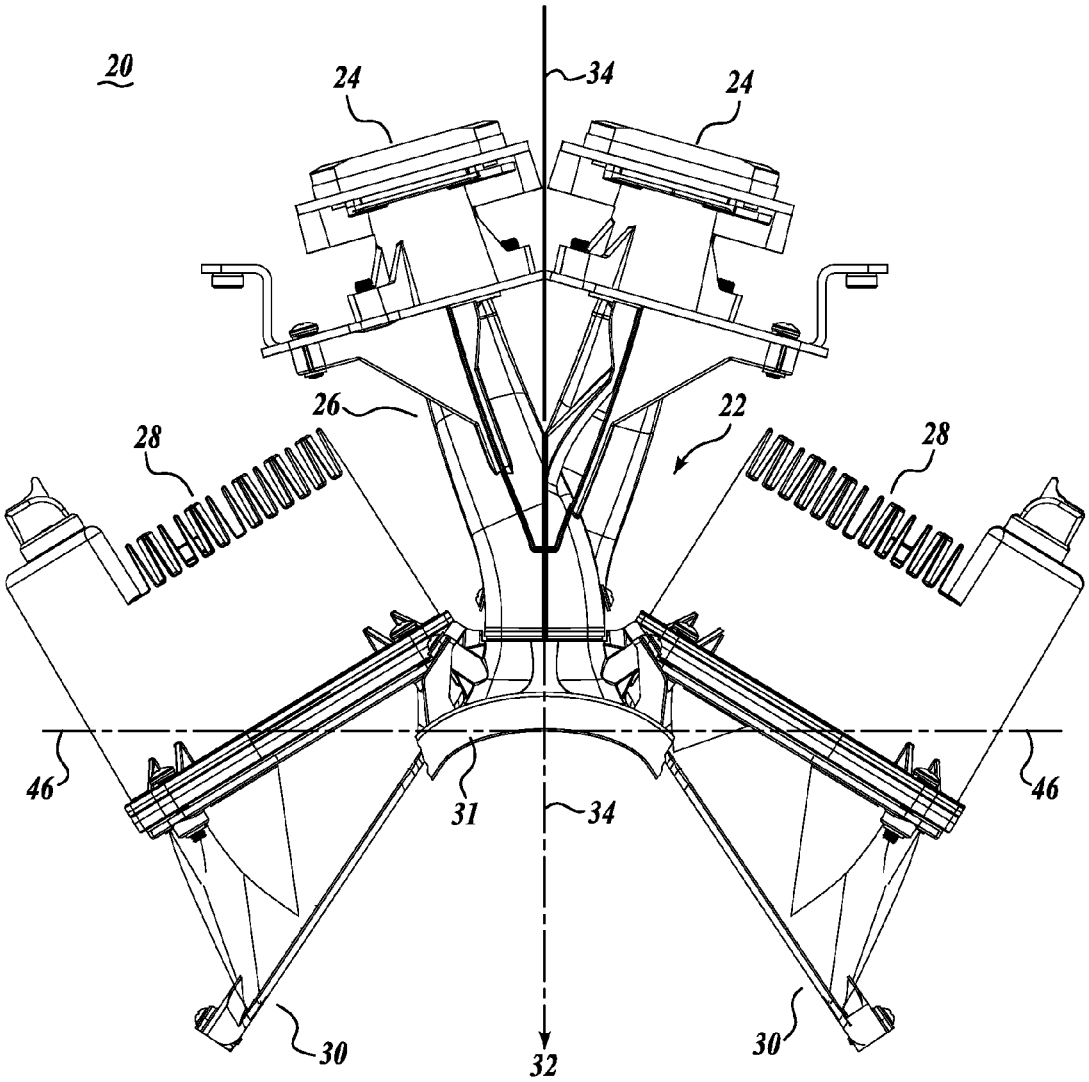
FIG. 2 is a top view of FIG. 1A.

Referring initially to FIGS. 1A, 1B and 2, the present disclosure includes a speaker assembly 20 shown outside or independent of an enclosure for housing the speaker assembly. The speaker assembly 20 includes a horn structure, or in the form of an acoustic horn manifold, 22 powered by high frequency drivers 24. As discussed more fully below, the horn structure 22 includes an array of horn pairs 26A-26G, with the horn pairs in stacked vertical relationship to each other. The speaker assembly 20 also includes cone-type speakers 28 mounted in a vertical array to each side of the horn structure 22. Phase plug 30 for the speakers 28 are shown mounted thereto. Also, horn flares 31 are shown at the mouths of horn structure 22.

Figure 3:
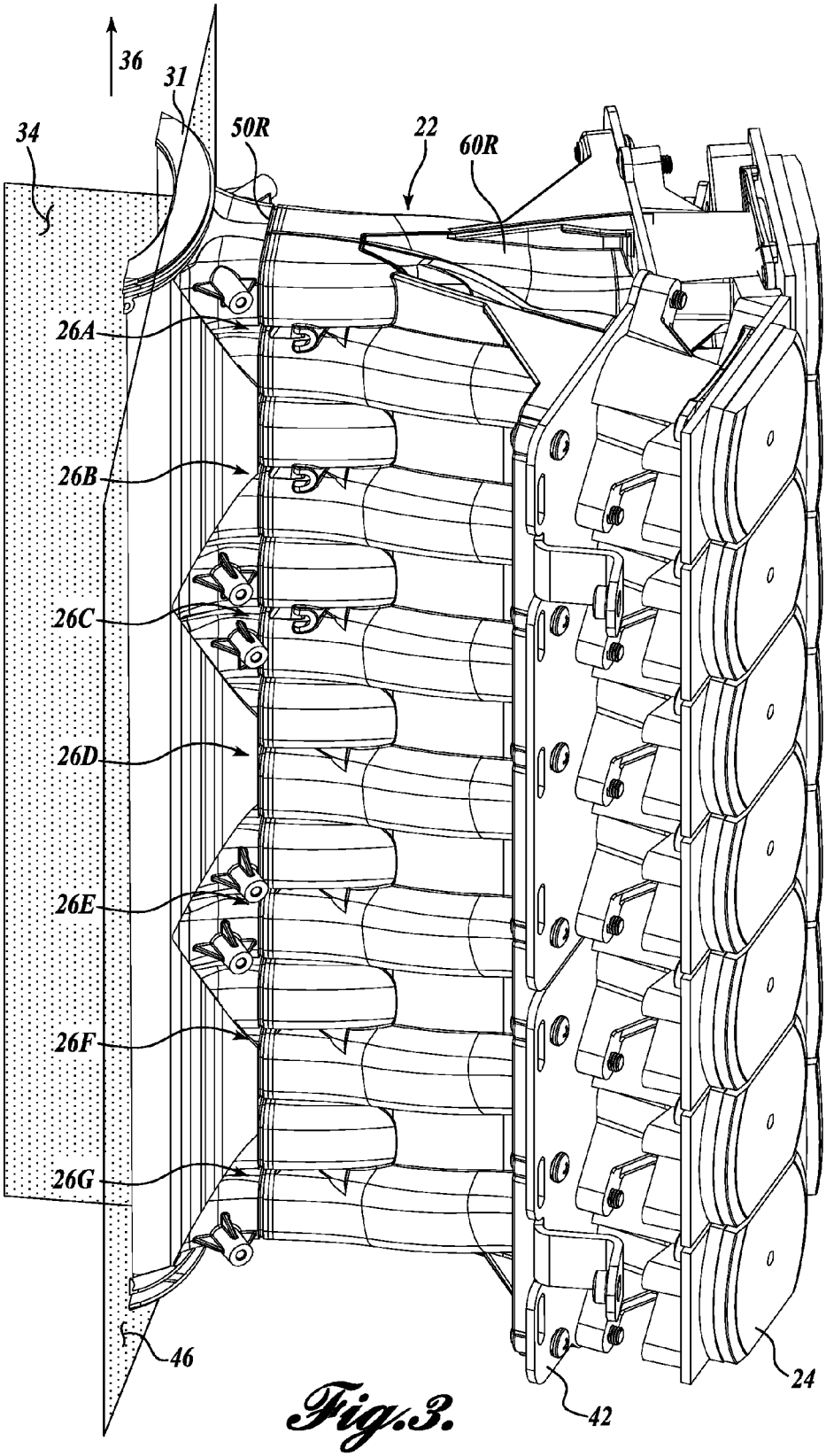
FIG. 3 is a side perspective view of the horn array of FIG. 1A with the lower frequency cone speakers removed.
Figure 4:
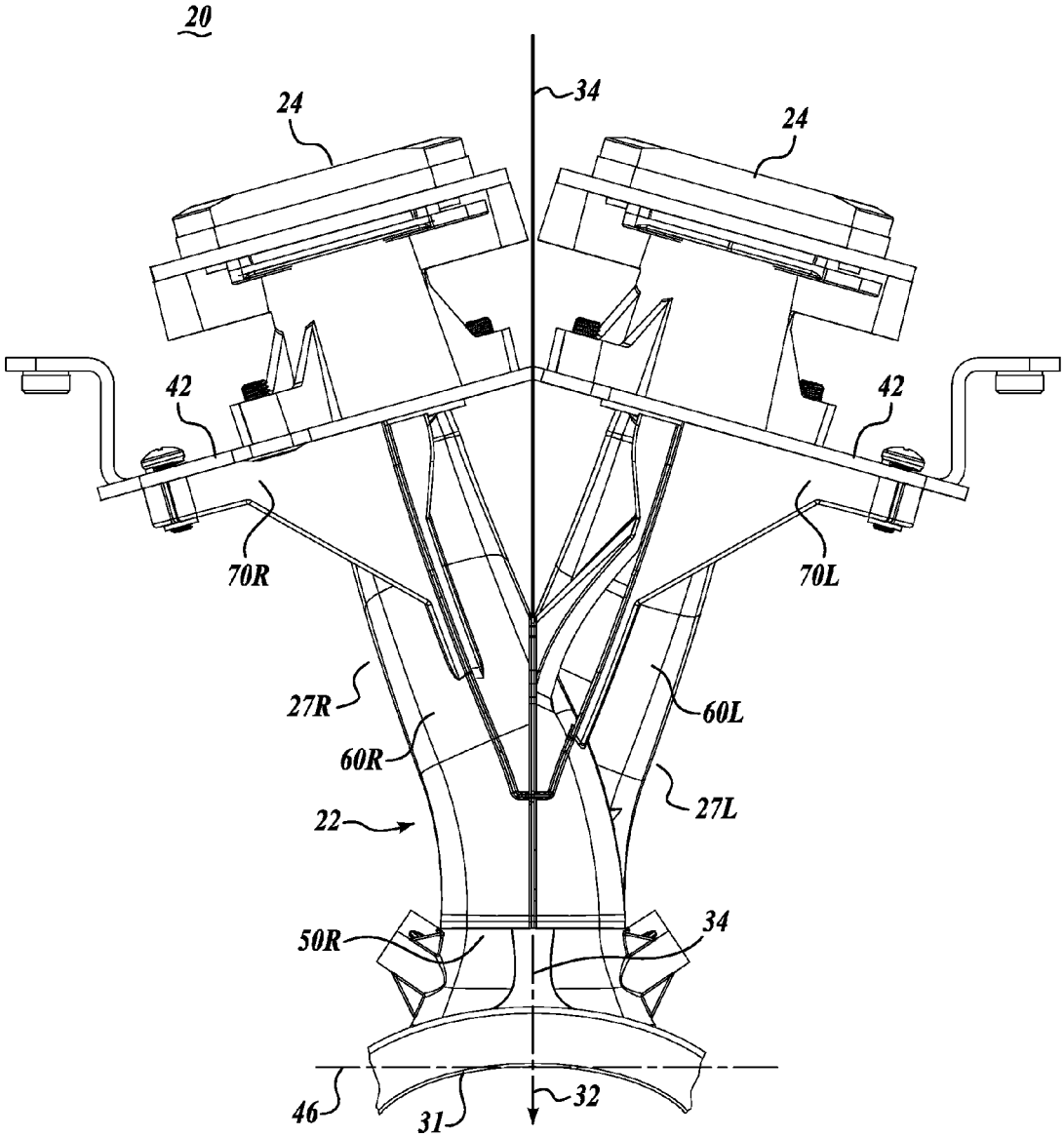
FIG. 4 is a top view of FIG. 3.
Figure 10:
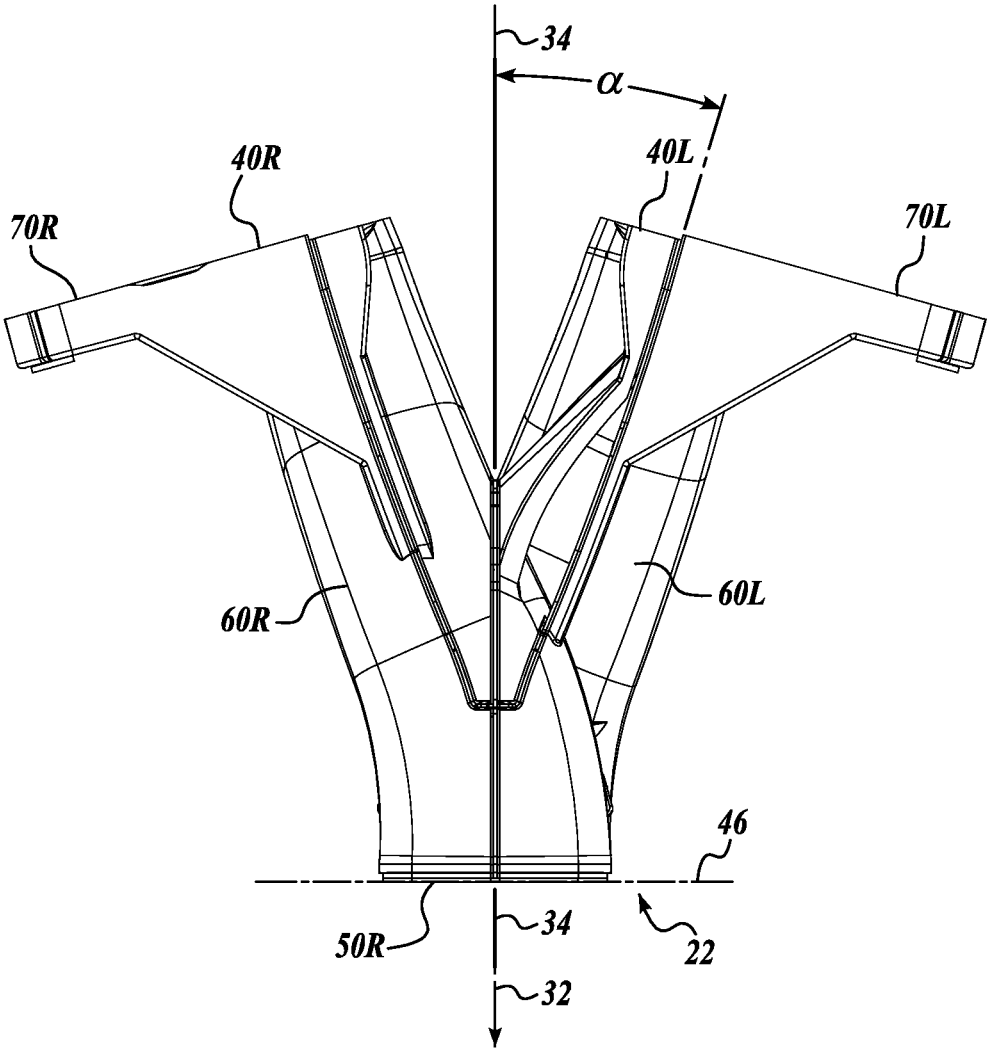
FIG. 10 is a top view of FIG. 5.

In FIGS. 2, 4 and 10, as well as in other figures, the "forward" direction is depicted by arrow 32, which is in alignment with a central vertical plane 34 that bisects speaker assembly and horn structure 22. Also, the upward direction is depicted by arrow 36 in FIGS. 1A and 3, as well as in other figures of the drawings, and the downward direction would be the direction opposite to arrow 36. The designation of the "forward," "rearward," "vertical," "horizontal," "lateral," "upward," and "downward" directions is only for purposes of helping to understand the present disclosure and does not limit the scope of the present invention. It is to be understood that the speaker assembly 20 can be utilized or installed in numerous positions including wherein the arrow 36 would not point necessarily vertically upward. Also, FIG. 1A shows three cone speakers 28 on each side of horn structure 22. It is to be understood that a smaller number or a larger number of cone speakers 28 could be utilized in conjunction with the speaker assembly 20.

Referring additionally to FIGS. 3 and 4, the speaker assembly 20 is shown with the cone speakers 28 removed. As shown in FIGS. 3 and 4, the horn structure, or acoustic horn manifold, 22 is composed of seven sets of horn pairs labeled as 26A, 26B, 26C, 26D, 26E, 26F, and 26G. These speaker pairs are disposed in a stacked array that is shown as vertical along plane 34. Moreover, each horn pair is composed of a left and right-hand horn designated as 27L and 27R, as shown in FIG. 4. A high frequency driver 24 is mounted to the inlets 40L and 40R of horns 27L and 27R, respectively. A mounting plate 42 is disposed between inlets 40L and 40R and corresponding drivers 24. The mounting plates 42 for each horn pair 26 may be joined together at a juncture corresponding to central plane 34, see FIG. 4. Also, of course, the mounting plates 42 can be individually constructed, one for each driver 24.

Referring additionally to FIGS. 5-10, the horn structure 22 is illustrated without drivers 24 or cone speakers 28. These figures clearly show that the horn structure 22 is composed of stacked horn pairs 26A-26G. While all seven pairs of horns 26 are illustrated, a greater number of horn pairs or a fewer number of horn pairs may be employed.

Figure 5:
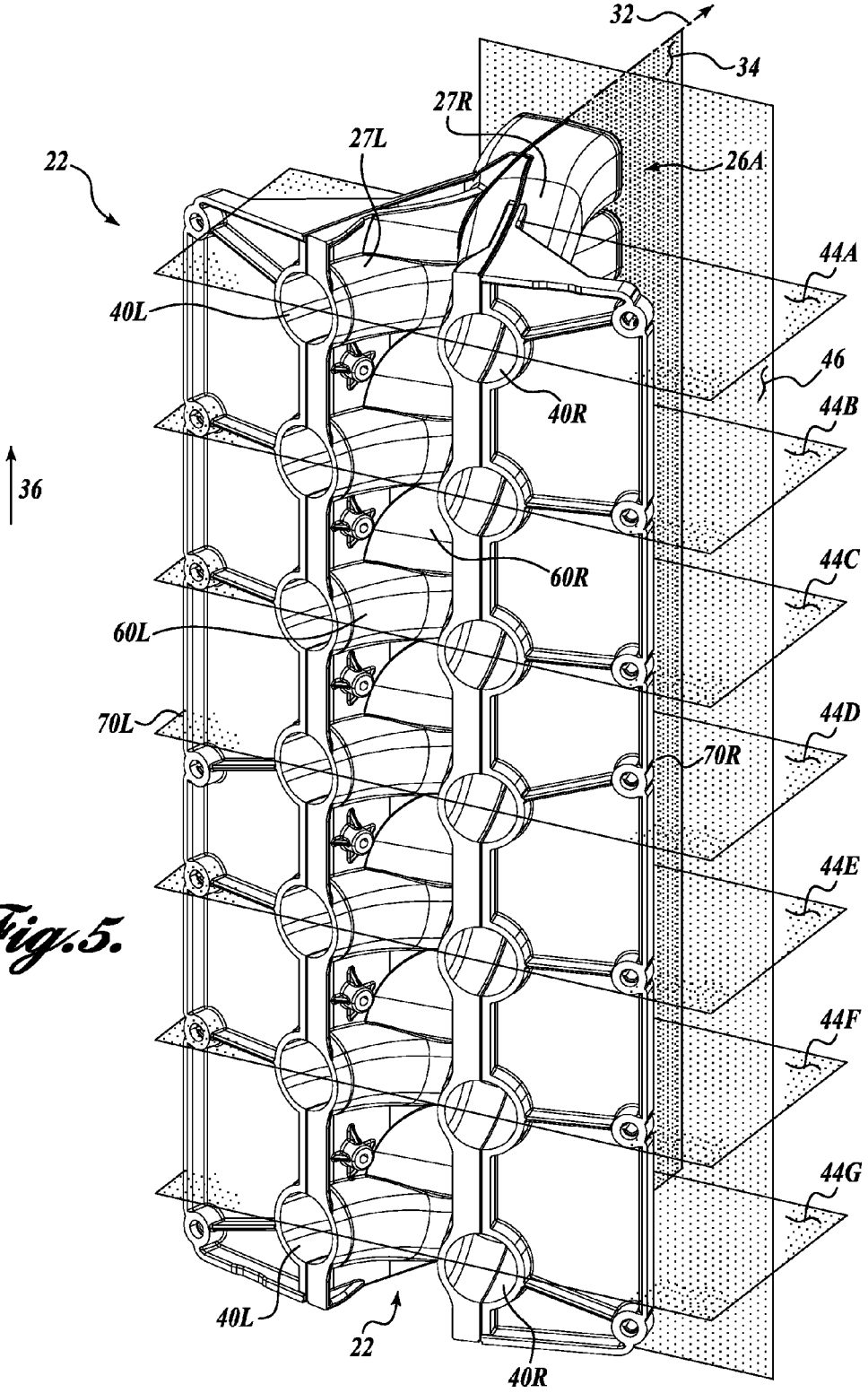
FIG. 5 is a rear perspective view of a horn array, with the high frequency drivers removed.
Figure 6:
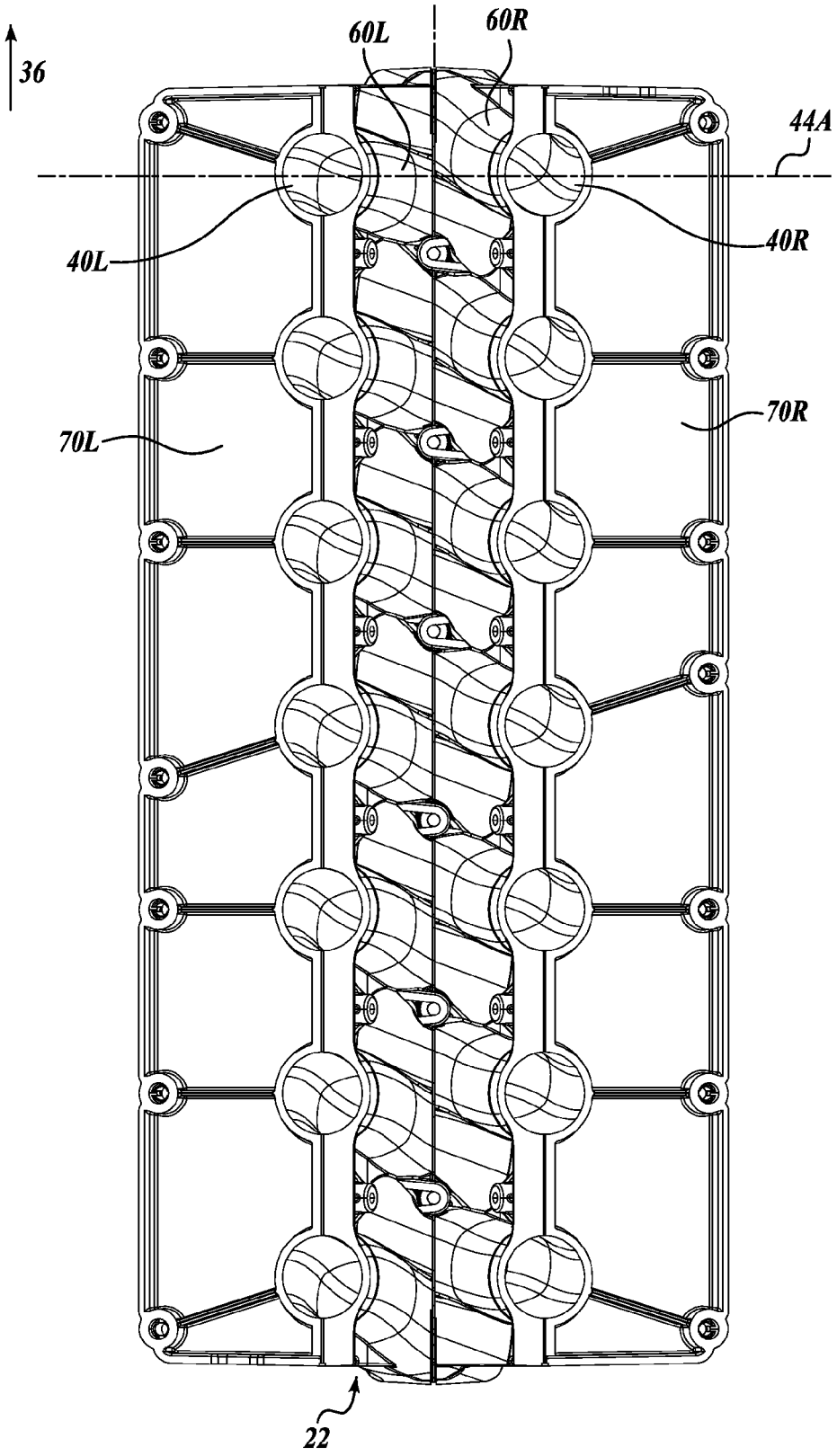
FIG. 6 is a rear view of FIG. 5.
Figure 7:
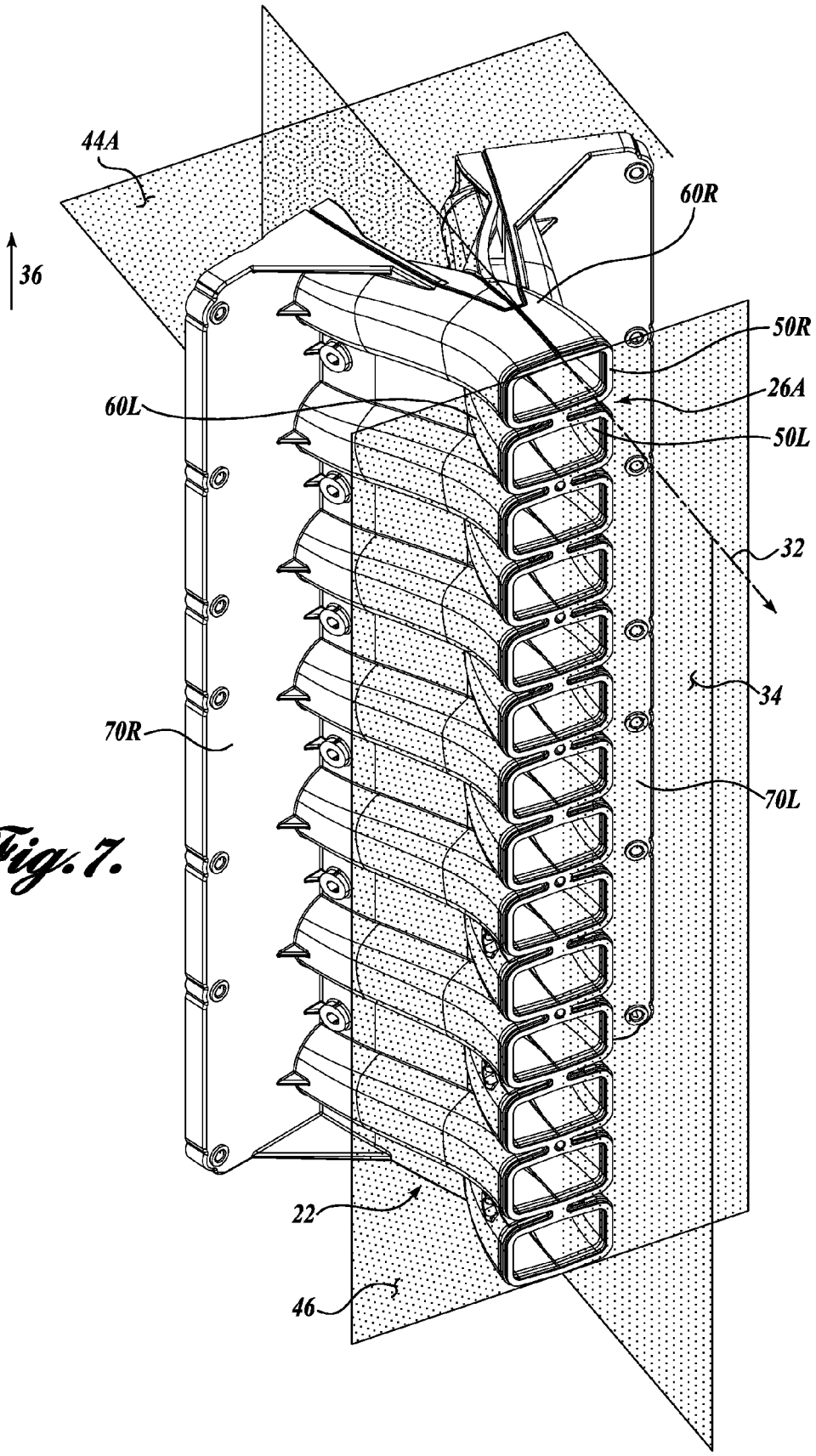
FIG. 7 is a front perspective view of FIG. 5.
Figure 8:
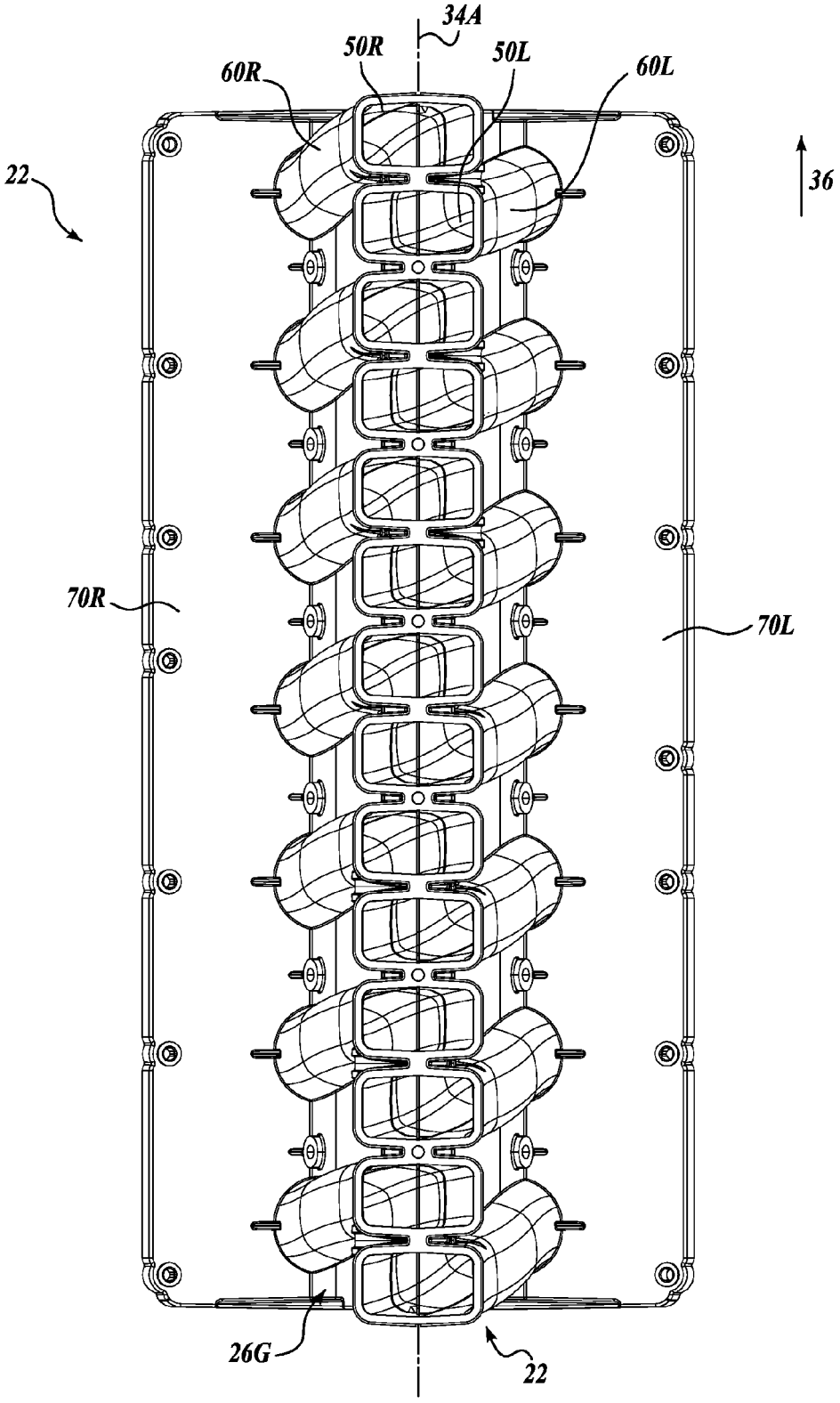
FIG. 8 is a front elevational view of FIG. 5.

As perhaps best shown in FIGS. 5 and 6, the entrance openings or inlets 40L and 40R of the horns 27L and 27R of each pair 26 are positioned side-to-side to each other along a common horizontal plane 44 that is transverse to the central plane 34. The entrance opening 40L and 40R are shown as being at the same elevation to one another corresponding to a plane 44 but they can be at different elevations to each other. The inlets 40L and 40R are also shown as round in shape, although the inlets do not necessarily have to be round. Also, as perhaps best illustrated in FIG. 10, the inlets 40L and 40R are angled or canted with respect to central plane 34 rather than being perpendicular to the axis. The angle $\alpha$ between central plane 34 and the central axis of inlets 40L or 40R can be selected so as to provide enough separation between the drivers 24 to avoid interference therebetween. Also, the angle can be chosen for desired performance characteristics. Although not limited to such angle, in FIG. 10, the angle $\alpha$ is shown as approximately 17 degrees. However, the angle $\alpha$ can be in the range of 0 to 180 degrees.

Horn mouths 50L and 50R are located at the opposite ends of horns 27L and 27R from the location of the horn inlets 40L and 40R. As perhaps most clearly shown in FIGS. 7 and 8, the horn mouths 50L and 50R are in directional alignment with central plane 34 and are disposed in adjacent relationship to each other to terminate at a vertical plane 46 that is disposed in a direction that is transverse to the side-to-side direction of the horn entrances 40L and 40R along plane 44 and also transverse to plane 34. In one embodiment of the present disclosure the horn mouths 50L and 50R are stacked on top of each other. In another embodiment of the present disclosure, this stacked relationship is a vertical stacked relationship along plane 34. In this regard, the mouth 50R of right horn 27R is positioned on top of mouth 50L of left horn 27L. Of course, the locations of the mouths 50L and 50R can be reversed from those illustrated in FIGS. 7 and 8.

Each of the mouths 50L and 50R are shown to be of the same rectilinear shape, and more specifically rectangular in shape having a width across the mouths 50L and 50R that is of a greater dimension than the height of the mouths. The dimensions of the width and height of the mouths are not directly related and can be of other relative dimensions. Also, one or both the width and height of the mouth can be selected based on the desired size of the throat "pinch" before the flare 31. Moreover, the mouths 50L and 50R can be formed in other shapes as desired, including, for example, oval or elliptical. Nonetheless, the shapes of mouths 50L and 50R are designed to achieve a desired directionality for the high frequency sounds emanating from the horn structure 22 of the speaker assembly 20. Such shape of the mouths 50L and 50R provides wide dispersion of sound in the horizontal direction as well as in the vertical direction. Moreover, by arranging the mouths 50L and 50R in a stacked array, efficient and effective summation of the high frequency sounds produced by the speaker assembly is achieved.

Each horn 27L and 27R includes an elongate throat 60L and 60R extending between corresponding inlets 40L and 40R and mouths 50L and 50R. As shown in the figures, each of the throats 60L and 60R extends (curves) diagonally inwardly in a forward direction toward central plane 34 and also to be in alignment with the central plane 34 at mouths 50L and 50R. In addition, the throat 60R extends (rises upwardly) in a smooth, curved manner a distance equaling the elevation change from the elevation of inlet 40R to the higher elevation of outlet 50R. Correspondingly, throat 60L descends downwardly a distance corresponding to the elevation change of inlet 40L to the elevation of mouth 50L. Throat 60L curves in a smooth arc to fold into a position beneath throat 60R. The throats 60L and 60R of the other horn pairs 26B-26G are constructed and shaped in a corresponding manner.

It will also be appreciated that the throats 60L and 60R smoothly transition from a round cross section at inlets 40L and 40R to the rectangular cross-sectional shape of mouths 50L and 50R. The smooth transition of the horn throats 60L and 60R minimizes losses by interference or otherwise of the audio output from the drivers 24.

As can be appreciated, in horn structure 22, the distance or dimension (vertical height) required for two mouths 50L and 50R is no more than the height (vertical) required by a single driver 24. This advantageously achieves a very closely arranged high frequency horn subassembly. This helps lead to an overall smaller envelope requirement for the speaker assembly 20 than if each of the horns 27L and 27R required more space.

Although each of the horns 27L and 27R can be individually constructed and then assembled together, the above-described structure for the horn set 22 enables the horns to be constructed as consolidated subassemblies, for example, one subassembly at each side of the central plane 34. It is possible to produce the horn structure 22 using permanent molds which are capable of achieving the rather complex shape of the horn structure very economically.

As shown in FIGS. 5-8, substantially planar flanges 70L and 70R extend vertically along the height of the horn structure 22 at each of the inlets 40L and 40R of the horns 27L and 27R, respectively. The flanges 70L and 70R extend laterally outwardly from the inlets 40L and 40R, thereby to tie the inlet portions of the horns together and also to provide a mounting structure for drivers 24. Although the flanges 70L and 70R are shown as substantially planar, they can, of course, be in other shapes.

The drivers 24 are constructed with permanent magnets and coils in the known manner of high frequency drivers. In the present situation, to achieve a lower vertical profile, the permanent magnets utilized in drivers 24 are rectilinear in shape, for example, or rectangular, in shape.

As shown in FIGS. 1A, 1B, 2, 3 and 4, the horn flares 31 are constructed as unitary structures to project forwardly from the horn mouths 50L and 50R. Each of the horn players is substantially the same shape as the corresponding horn mouths 50L and 50R, but flare outwardly in the horizontal direction from the horn mouths, thereby to enhance the horizontal projection of the sounds from the horn mouths. The horn flares 31 could be individually constructed rather than constructed as a unitary structure.

Figure 9:
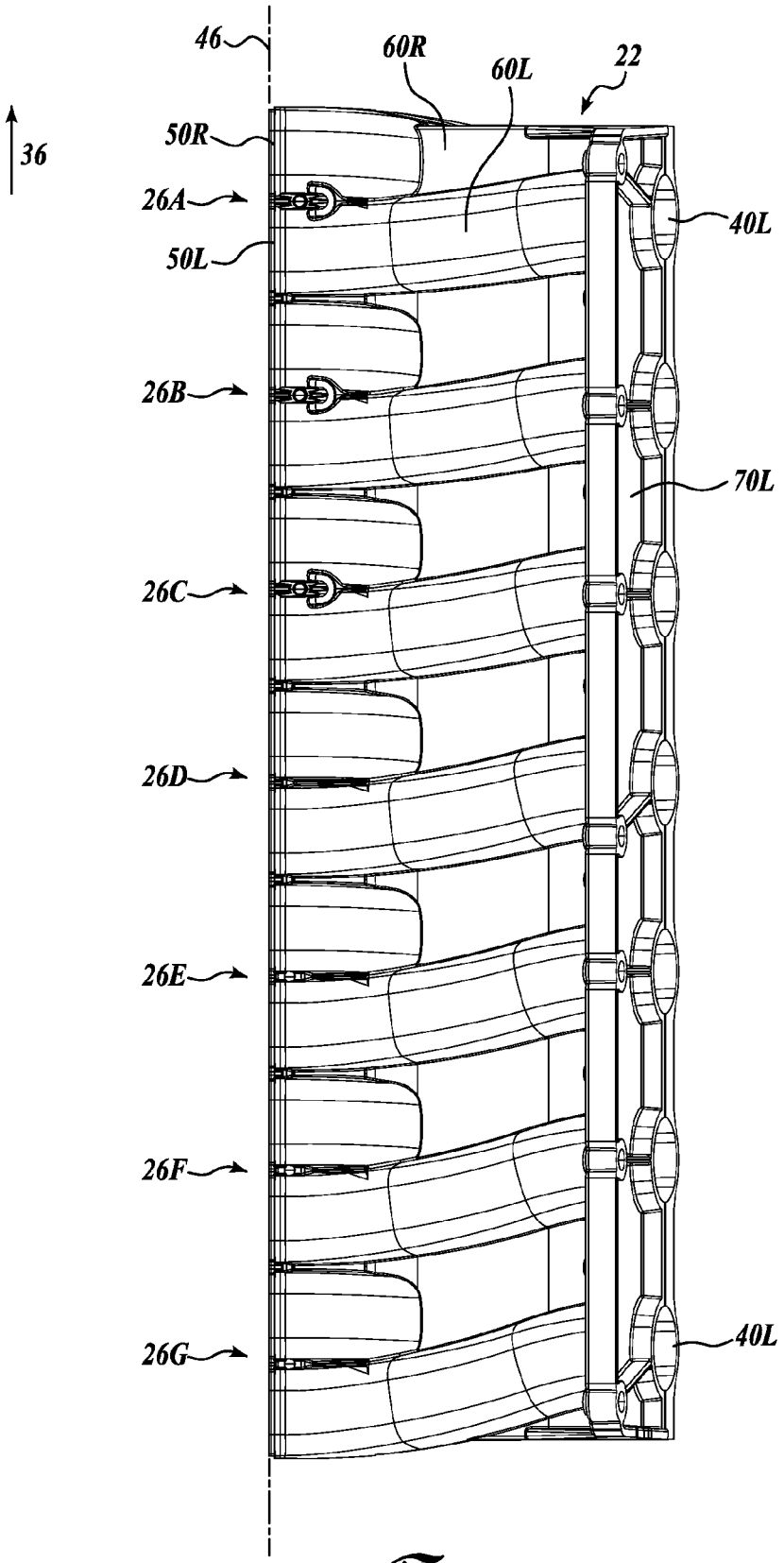
FIG. 9 is a side elevational view of FIG. 5.
Figure 11:
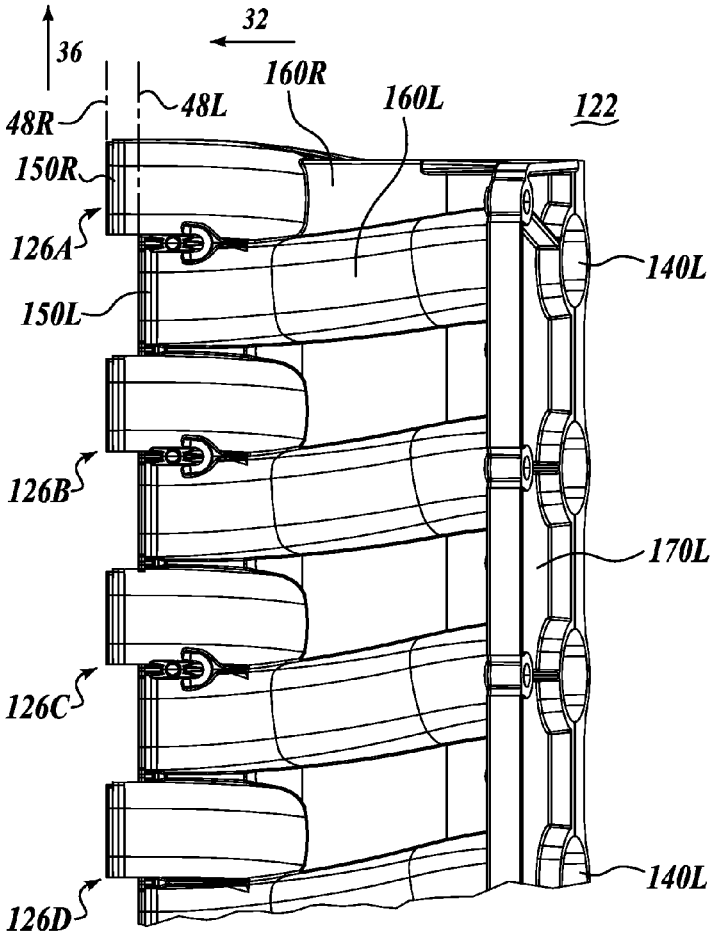
FIG. 11 is a partial side elevational view of a further embodiment of the present disclosure.

FIG. 11 is a partial elevational view of a horn structure 122, similar to the side elevational view of FIG. 9 showing a horn structure 122 that is similar to horn structure 22. Accordingly, the components of the horn structure 122 that correspond to horn structure 22 are identified with the same part number but in the 100 series. The horn structure 122 differs from the horn structure 22 in that the ends of the horn mouths 150R (which terminate at plane 48R) extend somewhat forwardly than the ends of the horn mouths 150L, which terminate at plane 48L. As shown in FIG. 11, plane 48R extends forwardly relative to inlets 40R and 40L, than the location of plane 48L. Thus, the distance separating the horn entrance 140R from the horn mouth 150R is different from the distance separating the horn entrance 140L from the horn mouth 150L. Other than this staggered arrangement of the horn mouths 150R and 150L, and correspondingly the planes 48R and 48L, the horn structure 122 is similar to the horn structure 22 shown in FIGS. 1-10.

Figure 12:
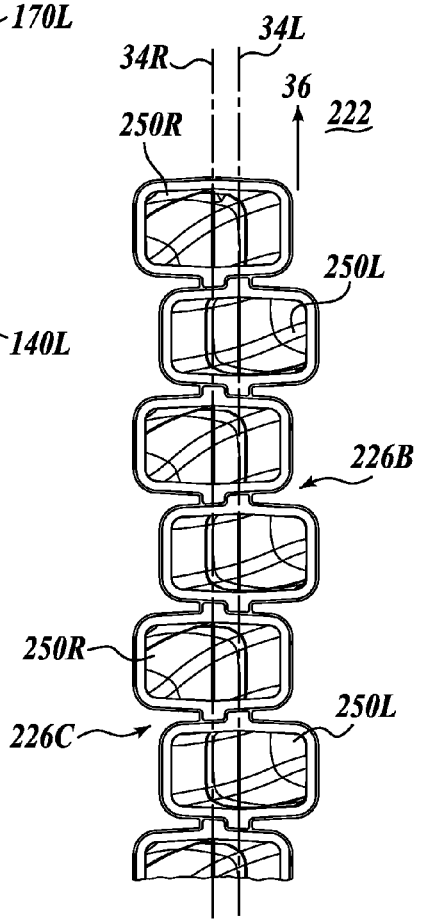
FIG. 12 is a partial front elevational view of a further embodiment of the present disclosure.

FIG. 12 is a further embodiment of the present disclosure showing a further horn structure 222 that is similar to horn structures 22 and 122 of FIGS. 1-11. Accordingly, the part numbers utilized in horn structure 122 are the same as utilized in FIGS. 1-11, but as a 200 series. As shown in FIG. 12, the horn mouths 250R and 250L are very similar to the horn mouths 50R and 50L shown in FIG. 8, but with the horn mouth 250R offset laterally somewhat from the horn mouth 250L. In this regard, horn mouths 250R are aligned with plane 34R and horn mouths 250L are aligned with plane 34L. Other than the side-to-side or lateral offset relationship of the horn mouths 250R and 250L, the horn structure 222 shown in FIG. 12 is similar to horn structures 22 and 122.

It will be appreciated that horn structures can be provided that incorporate both of the features of FIGS. 11 and 12. In this regard, the horn mouths may be laterally offset with each other as shown in FIG. 12 along planes 34R and 34L, as well as the ends of the horn mouths being staggered in the "front-to-back" direction of arrow 32 to terminate at planes 48R and 48L, shown in FIG. 11.

Also, the front to back staggered relationship of horn mouths 150R and 150L may be of a different arrangement wherein not all of the horn mouths 150R terminate at plane 48R and not all of the horn mouths 150L terminate at plane 48L. Rather, other variations of the termination locations of the horn mouths 150R and 150L may be used.

While illustrative embodiments have been illustrated and described, it will be appreciated that various changes can be made therein without departing from the spirit and scope of the invention. In this regard, although specific positional relationships are described and illustrated between and among horn entrances/inlets 40R and 40L and horn mouths 50L and 50R, other positioned relationships among horn entrances/inlets 40R and 40L and horn mouths 50L and 50R also are contemplated by the present disclosure. For example, the horn inlets 40R and 40L can be in elevationally staggered relationship to each other.

Although the horn structure 22 has been described in conjunction with high frequency sound generation, the horn structure can also be utilized in other, for example, lower, bandwidth sounds. In this regard, the speaker structure need not be employed in conjunction with mid-frequency or other lower frequency drivers, but could be used alone or without drivers of other frequencies.

The invention claimed is:

1. An acoustic horn manifold comprising at least one horn pair, each horn pair comprising:

a first horn with a first horn entrance, a first horn mouth spaced a first distance from the first horn entrance, and a formed, curved horn throat extending between the first horn entrance and the first horn mouth;

a second horn with a second horn entrance positioned side-to-side to the first horn entrance, a second horn mouth spaced a second distance from the second horn entrance, the second horn mouth disposed adjacent to the first horn mouth, and a formed, curved horn throat extending between the second horn entrance and the second horn mouth;

the first horn entrance and the second horn entrance are on a first common plane said common first plane extending through both the first and second horn entrances;

the first horn throat extends upwardly along the height of the acoustic horn manifold from the first common plane of the first horn entrance to the level of the first horn mouth;

the second horn throat extends downwardly along the height of the acoustic horn manifold from the first common plane of the second horn entrance to the level of the second horn mouth; and the first horn mouth and the second horn mouth are disposed adjacent to each other in a first direction that is transverse to the first common plane on which the first and second horn entrances are located, and the first horn mouth and the second horn mouth are offset from each other in a second direction transverse to the first direction.

2. An acoustic horn manifold according to claim 1, wherein:

the first horn entrance is separated from the first horn mouth by a third distance extending along a third direction transverse to the first common plane on which the first and second horn entrances are located; and the second horn entrance is separated from the second horn mouth by a fourth distance extending along a fourth direction transverse to the first common plane on which the first and second horn entrances are located, the second distance being substantially the same as the first distance and the third and fourth directions being opposite to each other.

3. An acoustic horn manifold according to claim 1, wherein:

the first horn entrance is canted at an angle from the angle of the first horn mouth; and the second horn entrance is canted at an angle from the angle of the second horn mouth, and in the opposite direction as the angle of the first horn entrance relative to the first horn mouth.

4. An acoustic horn manifold according to claim 1, wherein:

the first horn throat curves in at least two directions from the first horn entrance to the first horn mouth; and the second horn throat curves in at least two directions from the second horn entrance to the second horn mouth.

5. An acoustic horn manifold according to claim 1, wherein the first horn mouth and the second horn mouth are positioned one above the other along the height of the acoustic horn manifold.

6. An acoustic horn manifold according to claim 1, wherein the first and second horn mouths are substantially aligned in a common second plane that is transverse to the first common plane.

7. An acoustic horn manifold according to claim 1, wherein the first and second horn mouths terminate at a common third plane that is transverse to the first common plane.

8. An acoustic horn manifold according to claim 1, wherein the first distance separating the first horn entrance from the first horn mouth is different from the second distance separating the second horn entrance from the second horn mouth.

9. An acoustic horn manifold according to claim 1, further comprising a plurality of horn pairs, the plurality of horn pairs disposed in stacked relationship to each other along the height of the acoustic horn manifold.

10. An acoustic horn manifold according to claim 9, further comprising:

a first driver mounting flange section interconnecting the first horn entrances of the vertically stacked horn pairs; and a second driver mounting flange section interconnecting the second horn entrances of the vertically stacked horn pairs.

11. An acoustic horn manifold composed of a plurality of horn pairs, wherein the plurality of horn pairs are disposed in stacked relationship to each other along the height of the acoustic horn manifold, each horn pair comprising:

a first horn having a first horn entrance, a first horn mouth, and a first curved horn throat extending between the first horn entrance and first horn mouth to position the first horn entrance a first distance from the first horn mouth; and a second horn including a second horn entrance aligned side-to-side with the first entrance of the first horn, a second horn mouth, and a second curved horn throat extending between the second horn entrance and the second horn mouth to position the second horn entrance a second distance from the second horn mouth, wherein the first and second horn entrances are disposed at the same elevation along the height of the acoustic horn manifold; and wherein the first distance separating the first horn entrance from the first horn mouth is different from the second distance separating the second horn entrance from the second horn mouth.

12. The acoustic horn manifold according to claim 11, wherein for each horn pair:

in the first horn, the first horn mouth is positioned a third distance from the first horn entrance in a first transverse direction relative to the common first plane; and in the second horn, the second horn mouth is positioned a fourth distance from the second horn entrance in a second transverse direction relative to the first common plane, the first and second transverse directions being opposite to each other.

13. The acoustic horn manifold according to claim 11, wherein for each horn pair:

the throat of the first horn extends upwardly along the height of the acoustic horn manifold from the plane of the first horn entrance to the first horn mouth; and in the second horn of the pair, the throat extends downwardly along the height of the acoustic horn manifold from the plane of the entrance to the mouth of the second horn.

14. The acoustic horn manifold according to claim 11, wherein for each horn pair:

the throat of the first horn curves in two directions from the entrance of the first horn to the mouth of the first horn; and the throat of the second horn curves in two directions from the entrance of the second horn to the mount of the second horn, wherein the curvature of the second horn is in directions that are opposite to the curvature of the throat of the first horn.

15. The acoustic horn manifold according to claim 11, wherein:

the first horn entrance is canted at an angle from the angle of the first horn mouth; and the second horn entrance is canted at an angle from the angle of the second horn mouth, and in the opposite direction as the angle of the first horn entrance relative to the first horn mouth.

16. The acoustic horn manifold according to claim 11, wherein the first horn mouth and the second horn mouth are positioned one above the other along the height of the acoustic horn manifold and in alignment with a second common plane disposed transversely to the first common plane.

17. The acoustic horn manifold according to claim 11, wherein the mouths of all of the horns of the acoustic horn manifold are positioned in a vertical array along the height of the acoustic horn manifold.

18. The acoustic horn manifold according to claim 11, wherein the first horn mouth and the second horn mouth are positioned one above the other along the height of the acoustic horn manifold and are positioned laterally offset from each other.

* * * * *